US008771018B2

(12) United States Patent
McGrath

(10) Patent No.: US 8,771,018 B2
(45) Date of Patent: Jul. 8, 2014

(54) CARD EDGE CONNECTOR

(75) Inventor: James L. McGrath, Bloomingdale, IL (US)

(73) Assignee: Tyco Electronics Corporation, Berwyn, PA (US)

( * ) Notice: Subject to any disclaimer, the term of this patent is extended or adjusted under 35 U.S.C. 154(b) by 69 days.

(21) Appl. No.: 13/480,180

(22) Filed: May 24, 2012

(65) Prior Publication Data

US 2013/0316585 A1 Nov. 28, 2013

(51) Int. Cl.
*H01R 24/00* (2011.01)

(52) U.S. Cl.
USPC ..... 439/630

(58) Field of Classification Search
USPC ..... 439/630, 636, 637, 60
See application file for complete search history.

(56) References Cited

U.S. PATENT DOCUMENTS

| | | | | | |
|---|---|---|---|---|---|
| 4,241,381 | A | * | 12/1980 | Cobaugh et al. | 361/785 |
| 4,533,187 | A | | 8/1985 | Kirkman | |
| 5,024,609 | A | * | 6/1991 | Piorunneck | 439/637 |
| 5,026,292 | A | * | 6/1991 | Pickles et al. | 439/108 |
| 5,035,631 | A | * | 7/1991 | Piorunneck et al. | 439/108 |
| 5,051,099 | A | * | 9/1991 | Pickles et al. | 439/108 |
| 5,052,936 | A | * | 10/1991 | Biechler et al. | 439/60 |
| 5,096,435 | A | * | 3/1992 | Noschese et al. | 439/260 |
| 5,098,306 | A | * | 3/1992 | Noschese et al. | 439/188 |
| 5,496,180 | A | * | 3/1996 | Fabian et al. | 439/60 |
| 5,813,883 | A | * | 9/1998 | Lin | 439/637 |
| 5,836,792 | A | | 11/1998 | Thumma et al. | |
| 5,853,303 | A | * | 12/1998 | Brunker et al. | 439/637 |
| 5,919,049 | A | * | 7/1999 | Petersen et al. | 439/60 |
| 6,007,389 | A | * | 12/1999 | Weber | 439/857 |
| 6,015,299 | A | * | 1/2000 | Walse et al. | 439/60 |
| 6,095,821 | A | * | 8/2000 | Panella et al. | 439/60 |
| 6,254,435 | B1 | * | 7/2001 | Cheong et al. | 439/637 |
| 6,309,254 | B1 | * | 10/2001 | Korsunsky | 439/637 |
| 6,328,605 | B1 | | 12/2001 | Walker et al. | |
| 6,565,387 | B2 | * | 5/2003 | Cohen | 439/607.06 |
| 6,780,018 | B1 | * | 8/2004 | Shipe | 439/636 |
| 6,832,933 | B2 | * | 12/2004 | Bu et al. | 439/637 |
| 6,855,009 | B2 | * | 2/2005 | Nishiyama | 439/637 |
| 6,863,540 | B2 | | 3/2005 | Spykerman | |
| 6,994,563 | B2 | * | 2/2006 | Amini et al. | 439/62 |
| 7,048,585 | B2 | * | 5/2006 | Milbrand et al. | 439/607.09 |
| 7,182,616 | B2 | | 2/2007 | Shuey et al. | |
| 7,234,974 | B2 | * | 6/2007 | Henneberger et al. | 439/668 |
| 7,497,704 | B2 | | 3/2009 | Saito et al. | |
| 7,497,713 | B1 | * | 3/2009 | Huettner et al. | 439/265 |
| 7,637,783 | B2 | * | 12/2009 | Sasaoka et al. | 439/637 |
| 7,708,599 | B2 | * | 5/2010 | Guan et al. | 439/636 |
| 8,292,647 | B1 | * | 10/2012 | McGrath et al. | 439/327 |
| 2007/0004282 | A1 | | 1/2007 | Cohen et al. | |

* cited by examiner

*Primary Examiner* — Amy Cohen Johnson
*Assistant Examiner* — Vladimir Imas

(57) ABSTRACT

A card edge connector includes a housing having a mating end and a mounting end with a card edge slot configured to receive a circuit card therein. Signal contacts are held by the housing and have mating portions configured to be electrically coupled to corresponding signal pads of the circuit card and tail portions configured to be electrically coupled to a corresponding circuit board. Ground contacts are held by the housing and have tail portions configured to be electrically coupled to the circuit board, bifurcated portions extending from corresponding tail portion, first mating portions extending from corresponding bifurcated portions, and second mating portions extending from corresponding bifurcated portions.

20 Claims, 6 Drawing Sheets

CARD EDGE CONNECTOR

BACKGROUND OF THE INVENTION

The subject matter herein relates generally to card edge connectors.

There are numerous protocols used to communicate information among digital devices. Various standards have been applied to permit connection of peripheral devices such as network interface cards, storage adaptors, graphics cards, and other devices to a computer motherboard. For example, card edge connectors, connected to the motherboard, receive circuit cards or peripheral expansion boards. The peripheral expansion boards are available in a variety of form factors. Some peripheral expansion boards feature small form factors applicable to space constrained applications, such as notebook computers. Some peripheral expansion board form factors are targeted at desktop computers where more space is available to accommodate a larger form factor. One protocol which has been developed for transporting computer bus protocols is the PCI-Express (PCIe) protocol. Other protocols exist.

The card edge connectors include a card edge slot that receives the peripheral expansion board. The card edge connector holds many contacts for interfacing with corresponding pads on the peripheral expansion board. Due to size constraints, and the desire for smaller and smaller connector footprints, the many contacts are arranged in close proximity within the connector and at the mother board interface. Having the contacts in such close proximity affects the electrical performance of the contacts. For example, interference from other contacts degrades the signals and diminishes the overall electrical performance of the connector. At higher data rates, the signal degradation is more problematic.

A need remains for a connector operable at high data rates with improved electrical performance.

BRIEF DESCRIPTION OF THE INVENTION

In one embodiment, a card edge connector is provided including a housing having a mating end and a mounting end with a card edge slot configured to receive a circuit card therein. Signal contacts are held by the housing and have mating portions configured to be electrically coupled to corresponding signal pads of the circuit card and tail portions configured to be electrically coupled to a corresponding circuit board. Ground contacts are held by the housing and have tail portions configured to be electrically coupled to the circuit board, bifurcated portions extending from corresponding tail portion, first mating portions extending from corresponding bifurcated portions, and second mating portions extending from corresponding bifurcated portions.

Optionally, the mating portions of the signal contacts, the first mating portions of the ground contacts and the second mating portions of the ground contacts may be aligned within the card edge slot for electrical connection with the circuit card. The signal contacts may be arranged in pairs flanked by corresponding ground contacts. Optionally, M tail portions of the signal contacts may be provided while N tail portions of the ground contacts may be provided with M being approximately twice N.

Optionally, the card edge slot may extend longitudinally. The first and second mating portions of each ground contact may be longitudinally offset from the corresponding tail portion of such ground contact. The first and second mating portions of each ground contact may be laterally offset from the corresponding tail portion of such ground contact in a lateral direction generally perpendicular to the card edge slot. The tail portions of the signal contacts may be laterally offset from the corresponding mating portions of the signal contacts in an outer direction, and the tail portions of the ground contacts may be laterally offset from the corresponding first and second mating portions of the ground contacts in an inner direction generally opposite the outer direction.

In another embodiment, a card edge connector is provided including a housing having a mating end and a mounting end. The housing has a first side and a second side extending between the mating and mounting ends with a central plane between the first and second sides. The housing has a card edge slot extending along the central plane between the first and second sides that is configured to receive a circuit card therein. Signal contacts are held by the housing and arranged in a first group and a second group. The first group is between the central plane and the first side and the second group is between the central plane and the second side. The signal contacts have mating portions configured to be electrically coupled to corresponding signal pads of the circuit card and tail portions configured to be electrically coupled to a corresponding circuit board. The tail portions of the signal contacts are laterally offset away from the central plane from the mating portions. Ground contacts are held by the housing and arranged in a first group and a second group. The first group is between the central plane and the first side and the second group is between the central plane and the second side. The ground contacts have tail portions configured to be electrically coupled to the circuit board that are laterally offset toward the central plane. The ground contacts have bifurcated portions extending from corresponding tail portion. The ground contacts have first mating portions extending from corresponding bifurcated portions and second mating portions extending from corresponding bifurcated portions.

In a further embodiment, a connector system is provided including a circuit board having signal conductors and ground conductors and a card edge connector mounted to the circuit board. The card edge connector includes a housing having a card edge slot configured to receive a circuit card therein, signal contacts held by the housing, and ground contacts held by the housing. The signal contacts are electrically coupled to corresponding signal conductors. The ground contacts are bifurcated each having a single tail portion for being electrically coupled to corresponding ground conductors and a pair of mating portions for mating with the circuit card.

DETAILED DESCRIPTION OF THE INVENTION

Figure 1:
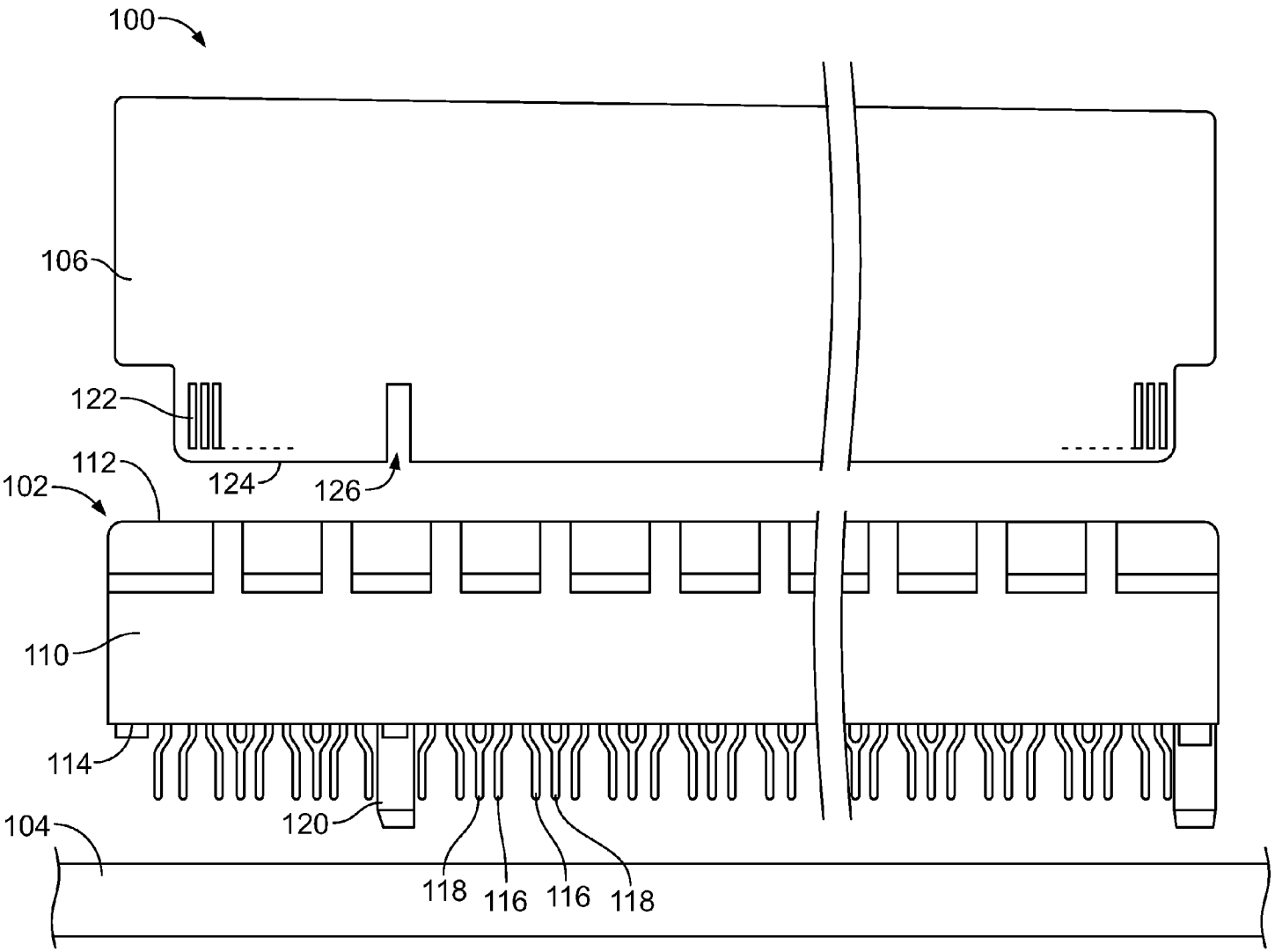
FIG. 1 illustrates a connector system formed in accordance with an exemplary embodiment.

FIG. 1 illustrates a connector system 100 formed in accordance with an exemplary embodiment. The connector system 100 includes a card edge connector 102 that is configured to be electrically connected to a circuit board 104, such as a mother board. The connector system 100 includes a circuit card 106 that is configured to be plugged into the card edge connector 102. The connector system 100 may form part of a data communication network, such as a PCI network. The circuit board 104 may be part of a server or other device and may have electronic circuits thereon and several electrical connectors used to process electronic data between the various electronic equipment of the PCI network. The circuit card 106 may be a PCI card that is inserted into the card edge connector 102. The circuit card 106 is electrically connected to circuits on the circuit board 104 by the card edge connector 102.

The card edge connector 102 includes a housing 110 having a mating end 112 and a mounting end 114. The mating end 112 is configured to receive the circuit card 106 therein. The mounting end 114 is configured to be mounted to the circuit board 104. The mating end 112 may be generally opposite the mounting end 114 defining a vertical card edge connector 102. In an alternative embodiment, the card edge connector 102 may be a right angle card edge connector 102 that receives the circuit card 106 in a horizontal direction such that the circuit card 106 is parallel to the circuit board 104.

The housing 110 holds a plurality of signal contacts 116 and a plurality of ground contacts 118. In an exemplary embodiment, the signal contacts 116 and ground contacts 118 are held in two rows within the housing 110 for mating with both sides of the circuit card 106. The signal contacts 116 and the ground contacts 118 are configured to be terminated to the circuit board 104. In an exemplary embodiment, the signal contacts 116 and the ground contacts 118 may be through-hole mounted to the circuit board 104. In an alternative embodiment, the signal contacts 116 and/or the ground contacts 118 may be surface mounted to the circuit board 104 rather than being through-hole mounted to the circuit board 104.

In an exemplary embodiment, the housing 110 includes one or more locating posts 120 extending from a mounting end 114. The locating posts 120 are configured to be received in corresponding openings (not shown) in the circuit board 104 to position the card edge connector 102 with respect to the circuit board 104.

The circuit card 106 includes a plurality of pads 122 that are configured to be electrically connected to corresponding signal contacts 116 or ground contacts 118. The pads 122 are arranged along an edge 124 of the circuit card 106. The edge 124 of the circuit card 106 is plugged into the card edge connector 102 when mated thereto. The circuit card 106 includes a keying feature 126 for orienting the circuit card 106 with respect to the card edge connector 102. In the illustrated embodiment, the keying feature 126 is a slot formed in the edge 124 that is offset forward one side of the circuit card 106.

Figure 2:
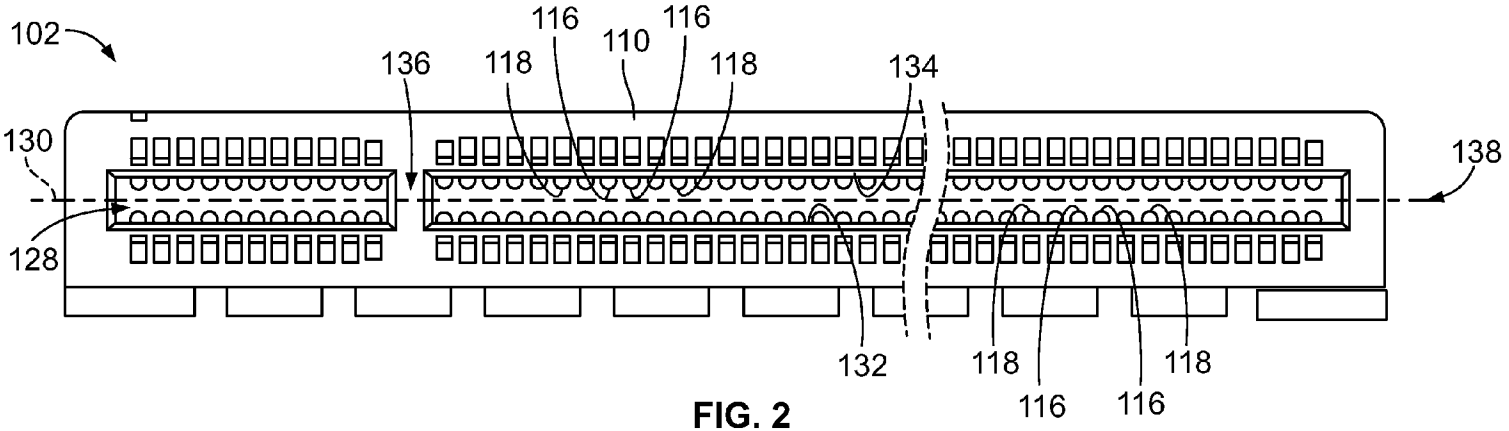
FIG. 2 is a top view of a card edge connector of the connector system.

FIG. 2 is a top view of the card edge connector 102. The card edge connector 102 includes a card edge slot 128 formed in the housing 110. The card edge slot 128 receives the circuit card 106 (shown in FIG. 1). The card edge slot 128 extends along a longitudinal axis 130 of the housing 110. The card edge slot 128 has a first side 132 and a second side 134 extending along the longitudinal axis 130. The housing 110 has a center plane 138 extending along the longitudinal axis 130. The card edge slot 128 extends along the central plane 138. The circuit card 106 is loaded into the card edge slot 128 and extends generally along the center plane 138. In an exemplary embodiment, the signal contacts 116 and the ground contacts 118 are arranged in groups along both the first side 132 and the second side 134 of the card edge slot 128. As such, the signal contacts 116 and the ground contacts 118 may be electrically connected to both sides of the circuit card 106.

In an exemplary embodiment, the housing 110 includes a keying feature 136 for orienting the circuit card 106 with respect to the card edge connector 102. In the illustrated embodiment, the keying feature 136 constitutes a bridge extending across the card edge slot 128. The keying feature 136 is received in the keying feature 126 (shown in FIG. 1) to position the circuit card 106 within the card edge slot 128.

Figure 3:
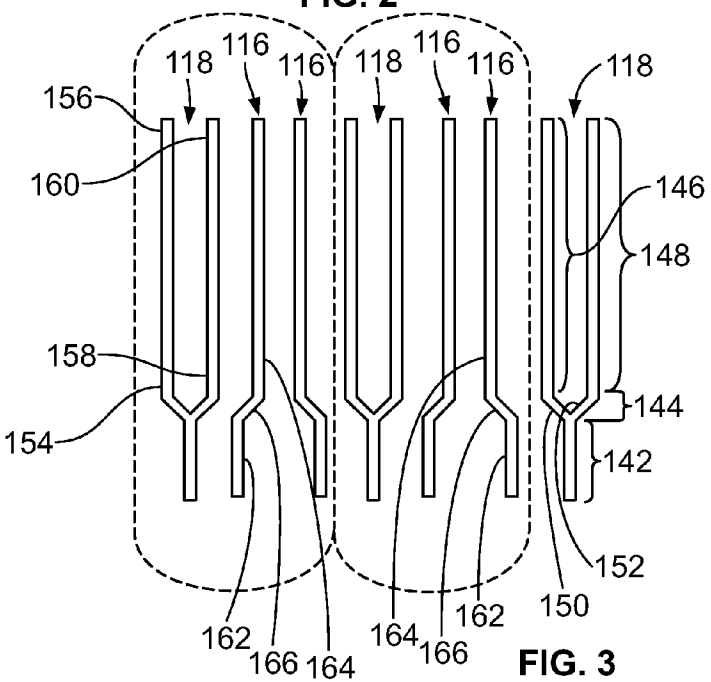
FIG. 3 illustrates a plurality of the signal contacts and the ground contacts of the card edge connector.

FIG. 3 illustrates a plurality of the signal contacts 116 and the ground contacts 118. In an exemplary embodiment, the ground contacts 118 are bifurcated having a single tail and a pair of mating ends for mating with the circuit card 106 (shown in FIG. 1). The bifurcated ground contacts 118 provide room for the tails of the signal contacts 116 to be splayed apart and away from one another for additional spacing and termination to the circuit board 104 (shown in FIG. 1).

In an exemplary embodiment, the signal contacts 116 and ground contacts 118 are arranged in contact sets 140. Each contact set 140 includes one ground contact 118 and a pair of signal contacts 116. The contact sets 140 are arranged in parallel with each other. Any number of contact sets 140 may be used with the card edge connector 102, depending on the particular application and contact configuration desired for the particular application. In an exemplary embodiment, the signal contacts 116 within each contact set 140 define a differential pair carrying differential signals. The ground contacts 118 separate each differential pair from an adjacent differential pair. Each ground contact 118 includes a tail portion 142, a bifurcated portion 144, a first mating portion 146 and a second mating portion 148.

The tail portion 142 is configured to be terminated to the circuit board 104 (shown in FIG. 1). In an exemplary embodiment, the tail portion 142 may be through-hole mounted to the circuit board 104, such as by being loaded into a plated via in the circuit board 104. The tail portion 142 may include a compliant section, such as an eye of the needle pin.

The bifurcated portion 144 extends from the tail portion 142. The bifurcated portion 144 transitions the ground contact 118 between the single tail portion 142 and the pair of the mating portions 146, 148. In an exemplary embodiment, the bifurcated portion is Y-shaped. Alternatively, the bifurcated portion 144 may be generally V-shaped. In other alternative embodiments, the bifurcated portion may be generally T-shaped, or may have other shapes depending on the particular desired spacing between the tail portion 142 and the mating portions 146, 148. The bifurcated portion 144 includes a first arm 150 extending between the tail portion 142 and the first mating portion 146. The bifurcated portion 144 includes a second arm 152 extending between the tail portion 142 and the second mating portion 148. The first and second arms 150, 152 are angled with respect to one another. Optionally, the first arm 150 and/or the second arm 152 may be angled with respect to the tail portion 142.

The first mating portion 146 extends between a base 154 and a tip 156. The base 154 extends from the bifurcated portion 144. The first mating portion 146, at the tip 156, is configured to be electrically coupled to a corresponding pad 122 (shown in FIG. 1) on the circuit card 106 (shown in FIG. 1) when mated thereto.

The second mating portion 148 includes a base 158 and a tip 160. The base 158 extends from the bifurcated portion 144. The second mating portion 148, at the tip 160, is configured to be electrically coupled to a corresponding pad 122 on the circuit card 106 when mated thereto. In an exemplary embodiment, the first mating portion 146 is generally parallel to the second mating portion 148.

Each signal contact 116 includes a tail portion 162 configured to be electrically coupled to the circuit board 104 and a mating portion 164 configured to be electrically coupled to a corresponding pad 122 on the circuit card 106. In an exemplary embodiment, each signal contact 116 includes a splayed portion 166 transitioning between the tail portion 162 and the mating portion 164. The splayed portion 166 longitudinally and/or laterally offsets the tail portion 162 from the mating portion 164. The splayed portion 166 transitions the tail portion 162 generally away from the tail portion 162 of the other signal contact 116 within the contact set 140. The tail portions 162 of the signal contacts 116 within each contact set 140 are positioned further from one another than the corresponding mating portions 164 of the signal contacts 116 of the contact set 140. Having greater separation of the tail portions 162 may provide a more desirable footprint for the card edge connector 102 for termination to the circuit board 104. By providing additional spacing between the tail portion 162 and the corresponding plated vias through the circuit board 104. The bifurcated portion 144 of the ground contact 118 provides space for the splayed portion 166 to transition the tail portions 162. In alternative embodiments, rather than having the splayed portions transitioning the tail portions 162 laterally, the tail portions 162 may remain in line with the mating portions 164.

Figure 5:
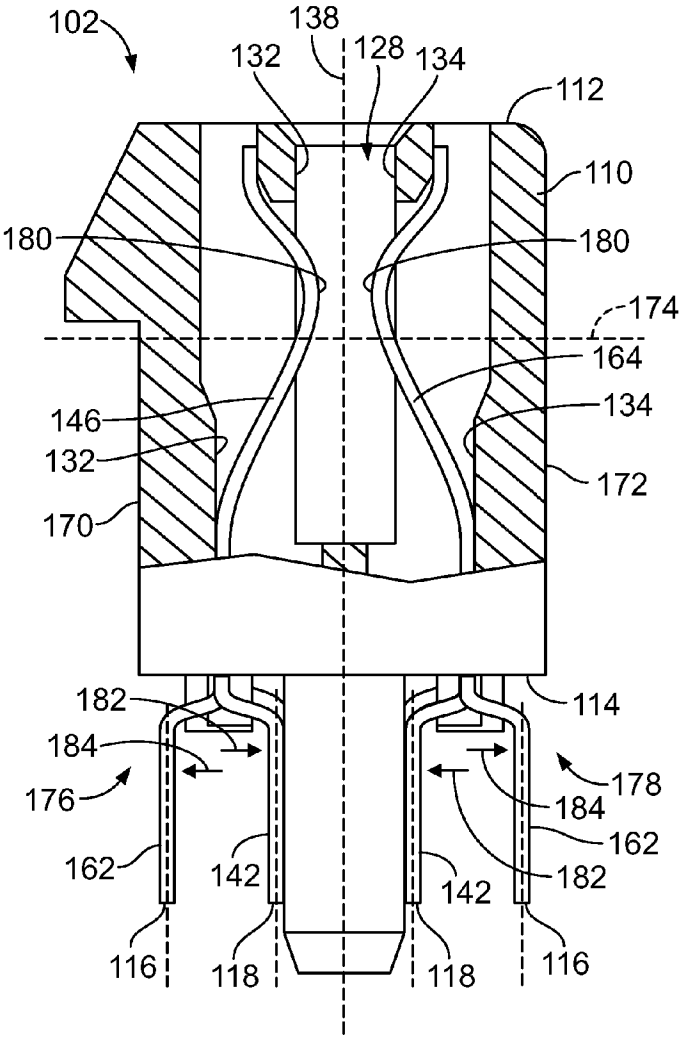
FIG. 5 is a partial sectional view of the card edge connector.
Figure 4:
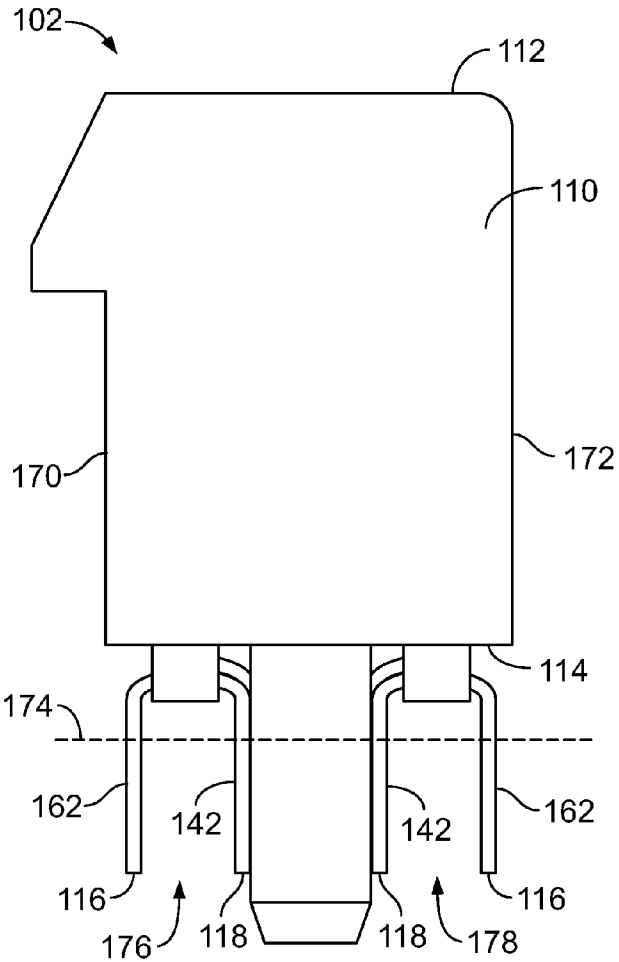
FIG. 4 is a side view of the card edge connector.

FIG. 4 is a side view of the card edge connector 102. FIG. 5 is a partial sectional view of the card edge connector 102. The housing 110 includes a first side 170 and a second side 172 laterally offset from the first side 170 along a lateral axis 174. The first and second sides 170, 172 extend between the mating end 112 and the mounting end 114. A first group 176 of the signal and ground contact 116, 118 are arranged near the first side 170 within the housing 110 and generally extend along the first side 132 of the card edge slot 128 (shown in FIG. 5). A second group 178 of the signal and ground contacts 116, 118 are provided near the second side 172 within the housing 110 and extend along the second side 134 of the card edge slot 128. In an exemplary embodiment, the signal and ground contacts 116, 118 transition laterally. For example, the mating portions 146, 148, 164 transition laterally inward toward a center of the card edge slot 128 to mating interfaces 180. The mating interfaces 180 are configured to engage corresponding pads 122 (shown in FIG. 1) of the circuit card 106 (shown in FIG. 1). In an exemplary embodiment, the mating portions 146, 148, 164 are deflectable and are configured to be spring biased against the circuit card 106, when the circuit card 106 is plugged into the card edge 128.

In an exemplary embodiment, the tail portions 142, 162 of the ground and signal contacts 118, 116 transition laterally. For example, the tail portions 142 of the ground contacts 118 transition laterally inward in an inner direction 182 toward a central plane 138 of the housing 110. The central plane 138 is centered between the first and second sides 170, 172. The card edge slot 128 extends along the central plane 138. The first group 176 of signal and ground contact 116, 118 are on one side of the central plane 138 while the second group 178 of signal and ground contact 116, 118 are on the other side of the central plane 138. The tail portions 142 of the ground contacts 118 in the first group 176 are transitioned toward the central plane 138 and toward the tail portions 142 of the ground contacts 118 of the second group 178. The tail portions 162 of the signal contacts 116 are transitioned laterally outward in an outer direction 184 away from the central plane 138. The tail portions 162 of all the signal contacts 116 of the first group 176 are aligned in a single row. Optionally the tail portions 162 may be approximately aligned with the first side 170 of the housing 110. The tail portions 162 of all the signal contacts 116 of the second group 178 are aligned in a single row. Optionally the tail portions 162 may be approximately aligned with the second side 172 of the housing 110. In an alternative embodiment, rather than having the tail portions 142, 162 transition laterally, the tail portions 142, 162 may be in line in a single row.

Figure 6:
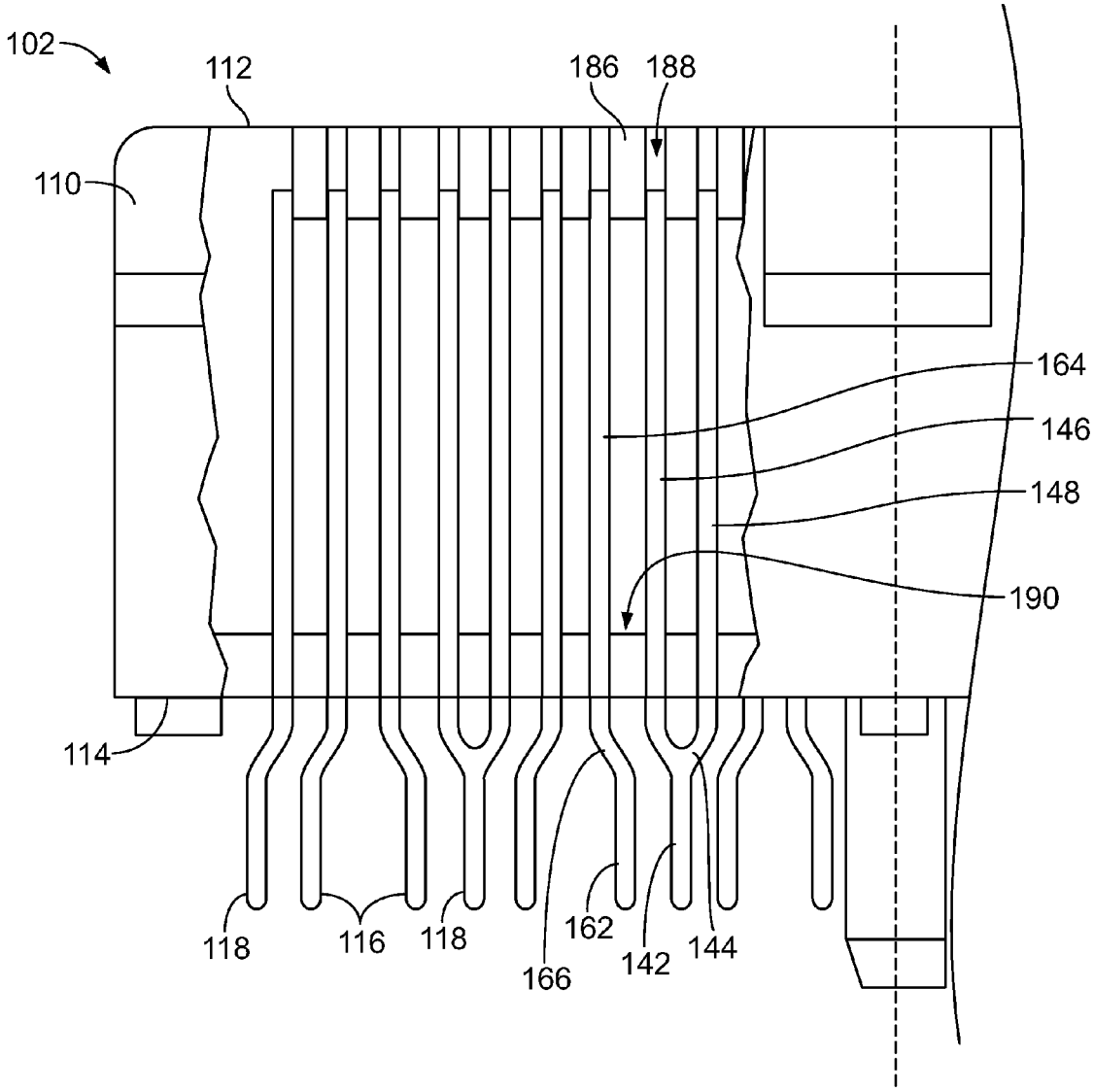
FIG. 6 is a partial sectional view of a portion of the card edge connector.

FIG. 6 is a partial sectional view of a portion of the card edge connector 102. The signal and ground contacts 116, 118 are held within the housing 110. The housing 110 includes dividers 186 proximate to the mating end 112. The dividers 186 define pockets 188 therebetween. The first and second mating portions 146, 148 of the ground contacts 118 and the mating portions 164 of the signal contacts 116 are received in corresponding pockets 188.

The signal and ground contacts 116, 118 extend through openings 190 at the mounting end 114 of the housing 110 to an exterior of the housing 110. In the illustrated embodiment, the bifurcated portions 144 of the ground contacts 118 are provided exterior of the mounting end 114 of the housing 110. In the illustrated embodiment, the splayed portions 166 of the signal contacts 116 are provided exterior of the mounting end 114 of the housing 110. Optionally, the signal and ground contacts 116, 118 may transition laterally and/or longitudinally exterior of the mounting end 114 of the housing 110 to position the tail portions 142, 162 from mounting to the circuit board 104 (shown in FIG. 1).

Figure 7:
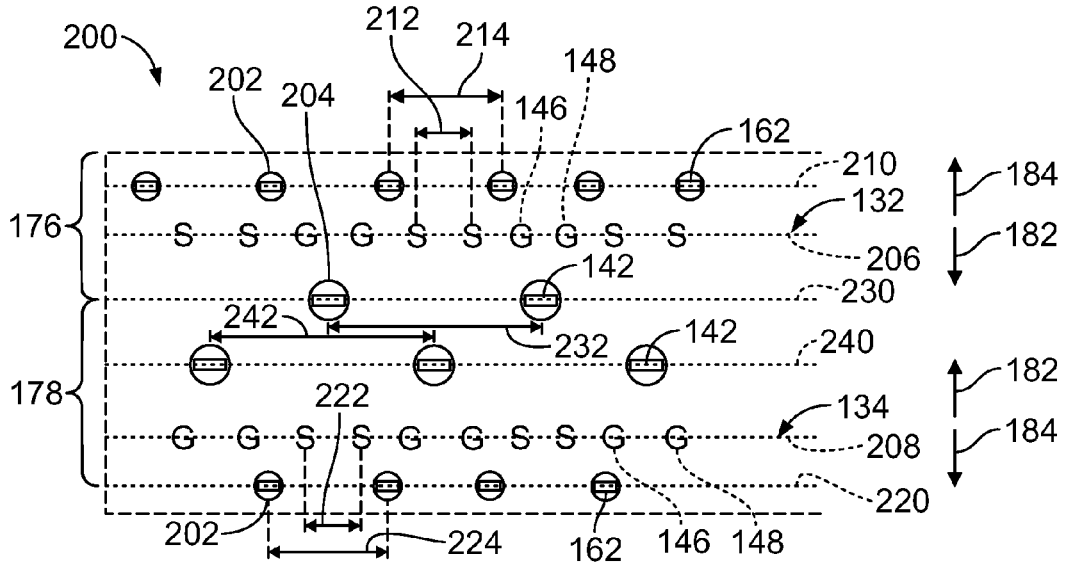
FIG. 7 illustrates a footprint of the card edge connector.

FIG. 7 illustrates a footprint 200 of the card edge connector 102 (shown in FIG. 1) and circuit board 104 (shown in FIG. 1). The footprint 200 is defined by the positions of the tail portions 142, 162. The footprint 200 corresponds to a layout of signal vias 202 and ground vias 204 of the circuit board 104 (shown in FIG. 1). The signal vias 202 and ground vias 204 define signal conductors and ground conductors, respectively, of the circuit board 104 and may be referred to as signal conductors 202 and ground conductors 204, respectively. The tail portions 142, 162 are represented by rectangles within the signal and ground vias 202, 204. FIG. 7 illustrates a first row 206 of signal and ground contacts 116, 118 (designated S and G, respectively) and a second row 208 of signal and ground contacts 116, 118. The first row 206 corresponds with the first group 176 of signal and ground contacts 116, 118 (shown in FIG. 5) and the second row 208 corresponds to the second group 178 of signal and ground contacts 116, 118. The signal and ground contacts 116, 118 of the first and second rows 206, 208 correspond to the relative positions of the signal and ground contacts 116, 118 within the housing 110, such as where the signal and ground contacts 116, 118 escape from the housing 110. The positions of the first and second rows 206, 208 may correspond to the positions of the signal and ground contacts 116, 118 extending along the first and second sides 132, 134 of the card edge slot 128 (shown in FIG. 2).

In an exemplary embodiment, all of the tail portions 162 of the signal contacts 116 in the first group 176 transition in the outer direction 184 from the first row 206. All of the tail portions 162 of the signal contacts 116 in the first group 176 are aligned along a first signal row 210 parallel to the first row 206. At the first row 206, the signal contacts 116 within each pair have a pitch 212. At the first signal row 210, the signal contacts 116 within each pair have a pitch 214 that is greater than the pitch 212. The splayed portions 166 (shown in FIG. 2) widen the pitch 214. The signal contacts 116 have a longitudinal spacing defining the pitch 212.

All of the tail portions 162 of the signal contacts 116 in the second group 178 are aligned along a second signal row 220 parallel to the second row 208. At the second row 208, the signal contacts 116 within each pair have a pitch 222. At the second signal row 220, the signal contacts 116 within each pair have a pitch 224 that is greater than the pitch 222. The splayed portions 166 (shown in FIG. 2) widen the pitch 224. The signal contacts 116 have a longitudinal spacing defining the pitch 222.

In an exemplary embodiment, all of the tail portions 142 of the ground contacts 118 in the first group 176 transition in the inner direction 182 from the first row 206. All of the tail portions 142 of the ground contacts 118 in the first group 176 are aligned along a first ground row 230 parallel to the first row 206. At the first row 206, the mating portions 146, 148 of the ground contacts 118 have a pitch 232. At the first ground row 230, only a single tail portion 142 is provided.

In an exemplary embodiment, all of the tail portions 142 of the ground contacts 118 in the second group 178 transition in the inner direction 182 from the second row 208. All of the tail portions 142 of the ground contacts 118 in the second group 178 are aligned along a second ground row 240 parallel to the second row 208. At the second row 206, the mating portions 146, 148 of the ground contacts 118 have a pitch 242. At the second ground row 240, only a single tail portion 142 is provided.

Figure 8:
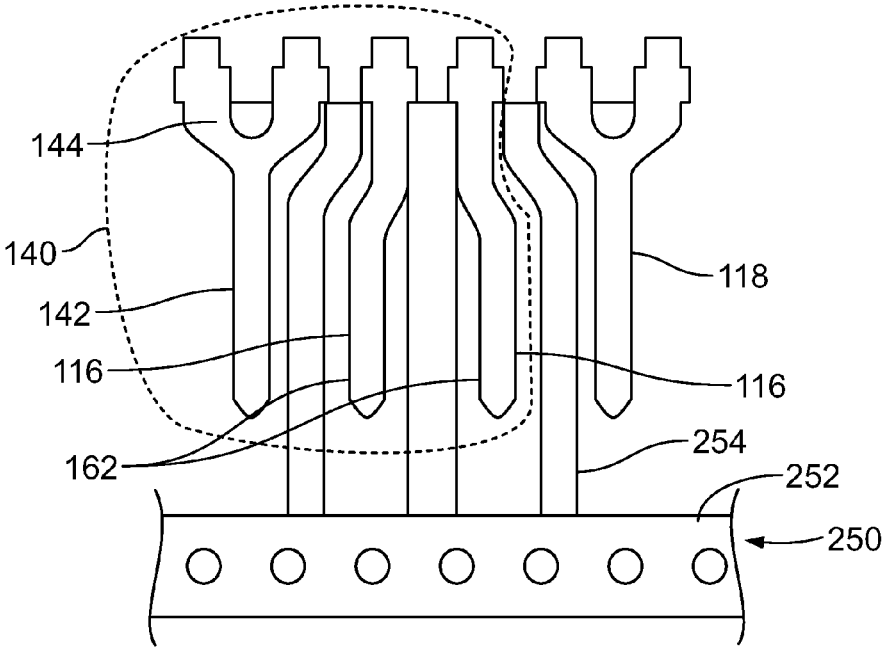
FIG. 8 illustrates a contact set of signal and ground contacts attached to a carrier strip.

FIG. 8 illustrates one of the contact sets 140 attached to a carrier strip 250. During manufacture, the signal and ground contacts 116, 118 are stamped and formed from a suitable metal sheet having the desired electrical and spring characteristics. The signal and ground contacts 116, and 118 are stamped and formed in strip form with the carrier strip 250 so that the signal and ground contacts 116, 118 can automatically be inserted into the housing 110 (shown in FIG. 1). Optionally, the carrier strip 250 may be simultaneously sheared from the respective signal and ground contacts 116, 118 as the signal and ground contacts 116, 118 are loaded into the housing 110.

The carrier strip 250 has a frame 252 with supports 254 extending from the frame 252. The supports 254 extend between corresponding signal and ground contacts 116, 118 to attachment locations where the support 254 are attached to the corresponding signal and ground contacts 116, 118. In an exemplary embodiment, each signal contact 116 is attached to two different supports 254. Each ground contact 118 is attached to two different supports 254. The signal and ground contacts 116, 118 are adequately held by the supports 254 for assembly into the housing 110. Additionally, only one carrier strip 250 is needed to support the signal and ground contacts 116, 118. In an exemplary embodiment, the bifurcated portions 144 transition the ground contact 118 into a single tail portion 142. A space savings is provided by such configuration allowing room for the support 254 to extend from the frame 252 between the tail portions 142, 162 to corresponding attachment points with the signal and ground contacts 116, 118.

Figure 9:
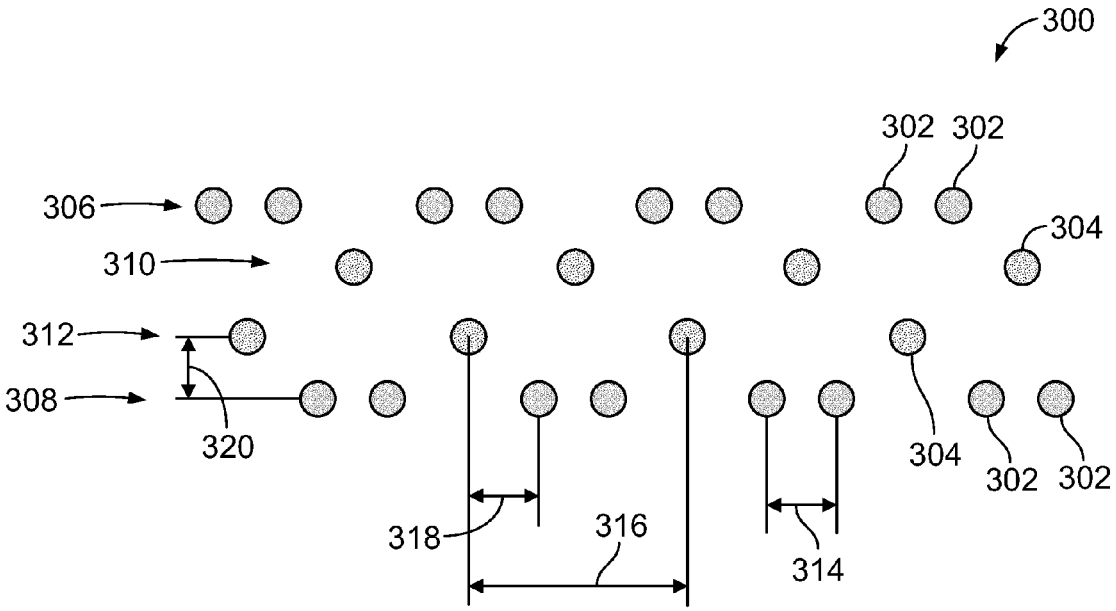
FIG. 9 illustrates an exemplary footprint 300 of the circuit board 104 shown in FIG. 1.

FIG. 9 illustrates an exemplary footprint 300 of the circuit board 104 (shown in FIG. 1). The footprint 300 corresponds to the positions of the tail portions 142, 162 (shown in FIG. 3). The footprint 300 is defined by an array of signal vias 302 and ground vias 304 of the circuit board 104 (shown in FIG. 1). The signal vias 302 and ground vias 304 define signal conductors and ground conductors, respectively, of the circuit board 104 and may be referred to as signal conductors 302 and ground conductors 304, respectively. FIG. 9 illustrates a first row 306 of signal vias 302 and a second row 308 of signal vias 302, both defining outer rows, and a first row 310 of ground vias 304 and a second row 312 of ground vias 304, both interior of the rows 306, 308 of signal vias 302. The first rows 306, 310 correspond with the tail portions 142, 162 of the first group 176 of signal and ground contacts 116, 118 (shown in FIG. 3) and the second rows 308, 312 correspond to the tail portions 142, 162 of the second group 178 of signal and ground contacts 116, 118.

At the first and second rows 306, 308 of signal vias 302, the signal vias 302 within each pair have a pitch 314. The first pitch 314 may be approximately 1.5 mm. At the first and second rows 310, 312 of ground vias 304, the ground vias 304 have a second pitch 316. The second pitch 316 may be approximately 4.0 mm. A third pitch 318 is defined longitudinally between the signal vias 302 and the nearest ground via 304. The third pitch 318 may be approximately 1.25 mm. A fourth pitch 320 is defined laterally between the rows 306, 310 and the rows 308, 312. The fourth pitch 320 may be approximately 1.25 mm. Other dimensions are possible in alternative embodiments. Having a single ground via 304 between pairs of signal vias 302, as opposed to two ground vias 304 in each row 310 or 312, allows the signal vias 302 to be spread further apart from each other and allows the signal vias 302 to be spread further apart from the corresponding ground vias 304.

Figure 10:
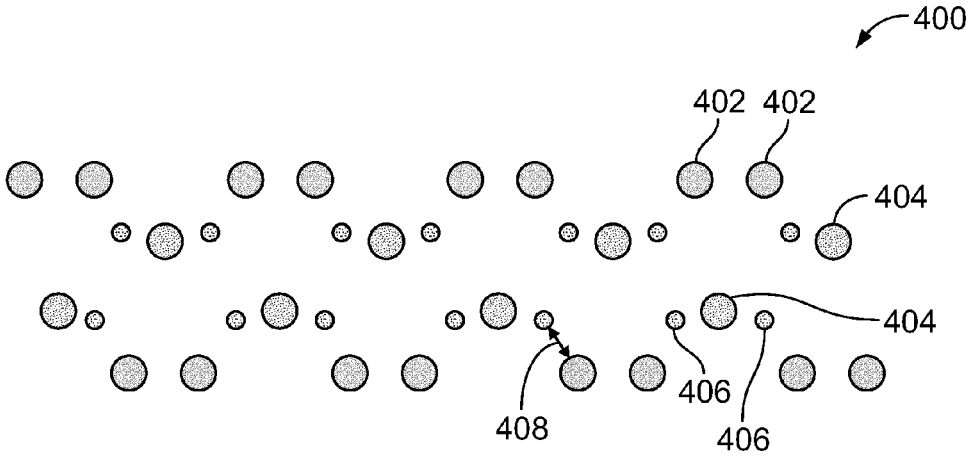
FIG. 10 illustrates an exemplary footprint 400 of the circuit board 104 (shown in FIG. 1.

FIG. 10 illustrates an exemplary footprint 400 of the circuit board 104 (shown in FIG. 1). The footprint 400 corresponds to the positions of the tail portions 142, 162 (shown in FIG. 4). The footprint 400 is defined by an array of signal vias 402 and ground vias 404 of the circuit board 104 (shown in FIG. 1). The signal vias 402 and ground vias 404 define signal conductors and ground conductors, respectively, of the circuit board 104 and may be referred to as signal conductors 402 and ground conductors 404, respectively. The array of signal and ground vias 402, 404 may be the same as the footprint 300 (shown in FIG. 9).

The footprint 400 includes an array of tuning vias 406 interspersed among the signal and ground vias 402, 404. The tuning vias 406 define ground conductors of the circuit board 104 and may be referred to as ground conductors 406. The tuning vias 406 are electrically grounded at the same electrical potential as the ground vias 404. The tuning vias 406 have a smaller diameter than the ground vias 404. While the ground vias 404 receive tail portions 142 of corresponding ground contacts 118, the tuning vias 406 do not receive any tails or pins, but rather are conductive vias extending through the circuit board 104.

The tuning vias 406 are positioned at predetermined positions relative to the signal vias 402 to affect the electrical performance of the signal lines. For example, spacings 408 may be defined between the tuning vias 406 and the signal vias 402. The spacings 408 may be varied across the footprint 400 rather than being uniform. The tuning vias 406 are positioned closer to the signal vias 402 than the ground vias 404 to maintain proper signal referencing to ground, such as to control impedance, return loss or other electrical characteristics. Any number of tuning vias 406 may be provided. The tuning vias 406 may surround the pairs of signal vias 402. The tuning vias 406 may be positioned between adjacent pairs of signal vias 402.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A card edge connector comprising:

a housing having a mating end and a mounting end, the housing haying a card edge slot configured to receive a circuit card therein;

signal contacts held by the housing, the signal contacts having mating portions configured to be electrically coupled to corresponding signal pads of the circuit card at mating interfaces of the signal contacts, the signal contacts having tail portions configured to be electrically coupled to a corresponding circuit board; and ground contacts held by the housing, the ground contacts having tail portions configured to be electrically coupled to the circuit board, the ground contacts having bifurcated portions extending from corresponding tail portion, the ground contacts having first mating portions extending from corresponding bifurcated portions, the ground contacts having second mating portions extending from corresponding bifurcated portions, the first and second mating portions having mating interfaces aligned with and interspersed among the mating interfaces of the signal contacts in the card edge slot for mating with the circuit card.

2. The card edge connector of claim 1, wherein the mating portions of the signal contacts, the first mating portions of the ground contacts and the second mating portions of the ground contacts are aligned within the card edge slot such that the first and second mating portions of the ground contacts are positioned directly between corresponding signal contacts to provide electrical shielding between the corresponding signal contacts.

3. The card edge connector of claim 1, wherein the signal contacts are arranged in pairs flanked by corresponding ground contacts with the first and second mating portions of the ground contacts positioned between and providing electrical shielding between the pairs of signal contacts.

4. The card edge connector of claim 1, wherein the signal contacts and ground contacts are arranged in the housing in a signal contact mating portion-ground contact mating portion-ground contact mating portion-signal contact mating portion configuration and in a signal contact tail portion-ground contact tail portion-signal contact tail portion configuration.

5. The card edge connector of claim 1, wherein the card edge slot extends longitudinally, the first and second mating portions of each ground contact being longitudinally offset from the corresponding tail portion of such ground contact.

6. The card edge connector of claim 1, wherein the card edge slot extends longitudinally, the first and second mating portions of each ground contact being laterally offset from the corresponding tail portion of such ground contact in a lateral direction generally perpendicular to the card edge slot.

7. The card edge connector of claim 1, wherein the tail portions of the signal contacts are laterally offset from the corresponding mating portions of the signal contacts in an outer direction, and wherein the tail portions of the ground contacts are laterally offset from the corresponding first and second mating portions of the ground contacts in an inner direction generally opposite the outer direction.

8. The card edge connector of claim 1, wherein M tail portions of the signal contacts are provided and N tail portions of the ground contacts are provided, M being approximately twice N.

9. A card edge connector comprising:

a housing having a mating end and a mounting end, the housing having a first side and a second side extending between the mating and mounting ends, the housing having a central plane between the first and second sides, the housing having a card edge slot extending along the central plane between the first and second sides configured to receive a circuit card therein;

signal contacts held by the housing, the signal contacts being arranged in a first group and a second group, the first group being between the central plane and the first side, the second group being between the central plane and the second side, the signal contacts having mating portions configured to be electrically coupled to corresponding signal pads of the circuit card, the signal contacts having tail portions configured to be electrically coupled to a corresponding circuit board, the tail portions of the signal contacts being laterally offset away from the central plane from the mating portions; and ground contacts held by the housing, the ground contacts being arranged in a first group and a second group, the first group being between the central plane and the first side, the second group being between the central plane and the second side, the ground contacts having tail portions configured to be electrically coupled to the circuit board, the tail portions of the ground contacts being laterally offset toward the central plane, the ground contacts having bifurcated portions extending from corresponding tail portion, the ground contacts having first mating portions extending from corresponding bifurcated portions, the ground contacts having second mating portions extending from corresponding bifurcated portions the first and second mating portions of the ground contacts being aligned with, and positioned directly between, the mating portions of corresponding signal contacts to provide electrical shielding between the signal contacts.

10. The card edge connector of claim 9, wherein the mating portions of the signal contacts of the first group, the first mating portions of the ground contacts of the first group and the second mating portions of the ground contacts of the first group are aligned laterally and vertically within the card edge slot for electrical connection with the circuit card, and wherein the mating portions of the signal contacts of the second group, the first mating portions of the ground contacts of the second group and the second mating portions of the ground contacts of the second group are aligned laterally and vertically within the card edge slot for electrical connection with the circuit card.

11. The card edge connector of claim 9, wherein the signal contacts are arranged in pairs flanked by corresponding ground contacts.

12. The card edge connector of claim 9, wherein the signal contacts and ground contacts are arranged in the housing in a signal contact mating portion-ground contact mating portion-ground contact mating portion-signal contact mating portion configuration and in a signal contact tail portion-ground contact tail portion-signal contact tail portion configuration.

13. The card edge connector of claim 9, wherein the card edge slot extends longitudinally, the first and second mating portions of each ground contact being longitudinally offset from the corresponding tail portion of such ground contact.

14. The card edge connector of claim 9, wherein the card edge slot extends longitudinally, the first and second mating portions of each ground contact being laterally offset from the corresponding tail portion of such ground contact in a lateral direction generally perpendicular to the card edge slot.

15. The card edge connector of claim 9, wherein the tail portions of the signal contacts are laterally offset from the corresponding mating portions of the signal contacts in an outer direction, and wherein the tail portions of the ground contacts are laterally offset from the corresponding first and second mating portions of the ground contacts in an inner direction generally opposite the outer direction.

16. The card edge connector of claim 9, wherein the tail portions of the signal contacts of the first group are aligned in a single row generally aligned with the first side of the housing, the tail portions of the signal contacts of the second group are aligned in a single row generally aligned with the second side of the housing, the tail portions of the ground contacts are arranged interior of the rows of tail portions of the signal contacts generally aligned with the central plane.

17. A connector system comprising:

a circuit board having signal conductors and ground conductors; and a card edge connector mounted to the circuit board, the card edge connector comprising a housing having a card edge slot configured to receive a circuit card therein, signal contacts held by the housing and arranged in pairs carrying differential signals, and ground contacts held by the housing, the signal contacts being electrically coupled to corresponding signal conductors, the ground contacts being bifurcated each having a single tail portion for being electrically coupled to corresponding ground conductors and a pair of mating portions for mating with the circuit card, the mating portions of the ground contacts being aligned with, and positioned directly between, mating portions of corresponding pairs of signal contacts to provide electrical shielding between the pairs of signal contacts.

18. The connector system of claim 17, wherein the mating portions of the signal contacts are configured to be electrically coupled to corresponding signal pads of the circuit card, the signal contacts having tail portions electrically coupled to corresponding signal conductors, and wherein the ground contacts have bifurcated portions extending from the corresponding tail portions, the ground contacts having first mating portions extending from corresponding bifurcated portions, the ground contacts having second mating portions extending from corresponding bifurcated portions.

19. The connector system of claim 17, wherein the signal conductors are arranged in a first signal row and a second signal row, the ground conductors being arranged in a first ground row and a second ground row on opposite sides of a central plane of the housing, the first and second ground rows being offset from, and interior of, the first and second signal rows in a space defined therebetween.

20. The connector system of claim 17, wherein the ground conductors of the circuit board comprise tuning vias extending through the circuit board at predetermined spacings from the signal conductors to achieve a target electrical impedance through the circuit board.

* * * * *